United States Patent [19]

Haack

[11] Patent Number: 4,509,395

[45] Date of Patent: Apr. 9, 1985

[54] PROCESS FOR PRECISION CUTTING

[75] Inventor: Johannes Haack, Lyss, Switzerland

[73] Assignee: Feintool AG Lyss, Lyss, Switzerland

[21] Appl. No.: 279,560

[22] Filed: Jul. 1, 1981

[30] Foreign Application Priority Data

Jul. 8, 1980 [EP] European Patent Office. 80200663.5

[51] Int. Cl.[3] ..... B26D 3/00

[52] U.S. Cl. ..... 83/55; 72/358

[58] Field of Search ..... 83/50, 55, 103, 454, 83/685, 635, 452, 453; 72/334, 335, 351, 333, 358; 10/78, 79, 80, 86 R

[56] References Cited

U.S. PATENT DOCUMENTS

| | | | |
|---|---|---|---|
| 1,147,364 | 7/1915 | Bidle et al. | 10/79 |
| 2,726,560 | 12/1955 | Roux | 72/345 |
| 3,174,318 | 3/1965 | Fox | 72/358 X |
| 3,296,905 | 1/1967 | Killaly | 83/685 |
| 3,554,065 | 1/1971 | Kunz | 83/55 |
| 3,731,516 | 5/1973 | Dohmann et al. | 72/354 |
| 3,788,177 | 1/1974 | Williamson | 83/454 |
| 3,971,275 | 7/1976 | Mach | 83/635 X |
| 4,277,994 | 7/1981 | Gargrave | 83/685 X |
| 4,299,112 | 11/1981 | Kondo et al. | 72/358 X |

FOREIGN PATENT DOCUMENTS

| | | | |
|---|---|---|---|
| 1292110 | 4/1969 | Fed. Rep. of Germany | 72/358 |
| 163048 | 12/1981 | Japan | 72/358 |
| 411948 | 6/1934 | United Kingdom | 10/79 |
| 836706 | 6/1960 | United Kingdom | 72/358 |

*Primary Examiner*—William R. Briggs

*Attorney, Agent, or Firm*—Oblon, Fisher, Spivak, McClelland & Maier

[57] ABSTRACT

A process for precision cutting of a hole near the edge of a thin workpiece. Clamping of the workpiece laterally adjacent the hole to minimize deformation of the workpiece is achieved prior to cutting the hole with a cutting punch.

23 Claims, 18 Drawing Figures

PROCESS FOR PRECISION CUTTING

Figure 1:
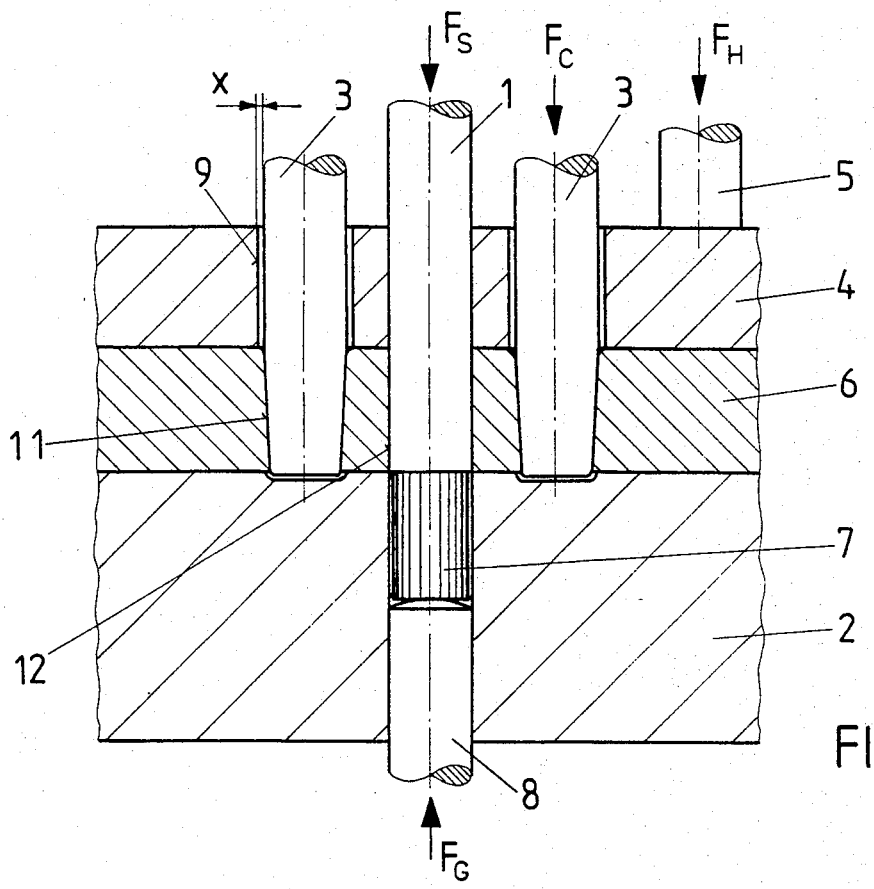

The invention relates to a tool for a precision-cutting machine and to a process for operating this tool.

Tools and processes in the art of precision cutting are known, for example, from the manual "Precision Cutting", Publisher: Feintool AG, Lyss (Switzerland), 2nd Edition 1977, for example pages 66, 67, 81 and 82. The art of precision cutting differs from normal stamping especially in that, before the start of the cutting operation, the workpiece is clamped between a cutting plate and a press plate, also called a cutting and retaining plate, and a pressure pad counteracts, on the opposite side, the cutting or piercing punch acting on the workpiece. The retaining plate and, if required, also the cutting plate each carry a knife-edged ring which follows the reference contour and which is pressed into the workpiece before the cutting operation. In this technique, the bending which is unavoidable in conventional stamping is prevented, and there are obtained smooth cuts free of break-offs, which guarantee a narrow tolerance of the workpieces and which save additional finishing work on the cut faces, such as shaving, grinding, etc.

Precision-cut parts are used, nowadays, in many branches of industry, in thicknesses of between 0.3 mm and 15 mm.

However, it has not yet been possible, hitherto, to apply precision cutting to the manufacture of parts having holes, the diameters or web and edge widths of which are considerably less than the thickness of the material.

It has been possible, hitherto, to make parts of this type only by means of machining processes, that is to say, drilling or milling. However, these processes not only result in chips which are difficult to eliminate, but also require a subsequent burr-removing operation. They are therefore uneconomical.

Conventional stamping is not suitable for the manufacture of parts of this type. When the values fall below $D/S=1$ or $A/S=1$ (with D denoting the diameter of the hole, S the thickness of the material and A the web or edge width) or when material thicknesses of 15 mm are exceeded, there arise, on the one hand, problems of durability of the tools which do not withstand the pressure load required and, on the other hand, deformations of the holes.

By means of precision cutting of the known type, that is to say, with a knife-edged ring and with a clamping force and counterforce, the limiting values for normal stamping can, it is true, be somewhat improved, and an improvement in the quality of the cut parts is also exhibited, but even these values are still not sufficient for many practical cases.

The object of the invention is, therefore, to improve a known precision-cutting tool of the type mentioned in the introduction, and to provide a process for operating this tool, in such a way that cut faces with a smooth cut, that is to say free of break-offs, can be produced up to limiting values lying considerably below those obtained hitherto.

This object is achieved by means of the features mentioned in the claims.

The essence of the invention is to be seen in the fact tht the material is supported laterally, on its shell surface, outside the cutting line at critical points by means of the supporting members. In the first place, the critical factor is always that part of the shell surface outside the cutting line which is nearest the latter and of which the distance therefrom, namely the web or edge width, is less than the material thickness. However, even when this distance is greater than the material thickness, but the diameter of the hole to be cut is less than the material thickness, the invention has a surprisingly advantageous effect: obviously, because of the support, the distribution of pressure in the workpiece is influenced favourably, to such an extent that the cutting operation is made considerably easier as a result and, consequently, the lifetime of the tool is effectively increased. However, especially in this case, the cutting punch should be surrounded on its entire periphery by one or more supporting members.

By means of the invention, the values which can be obtained in precision cutting with a knife-edged ring are improved to an unforeseeable extent. It is possible, by means of the invention, to produce internal and external shapes up to the limiting values $D/S \geqq \frac{2}{3}$; $A/S \geqq \frac{1}{3}$ in steel and non-ferrous metals, in the case of thicknesses of 1 mm to 20 mm, even up to 30 mm.

Figure 2:
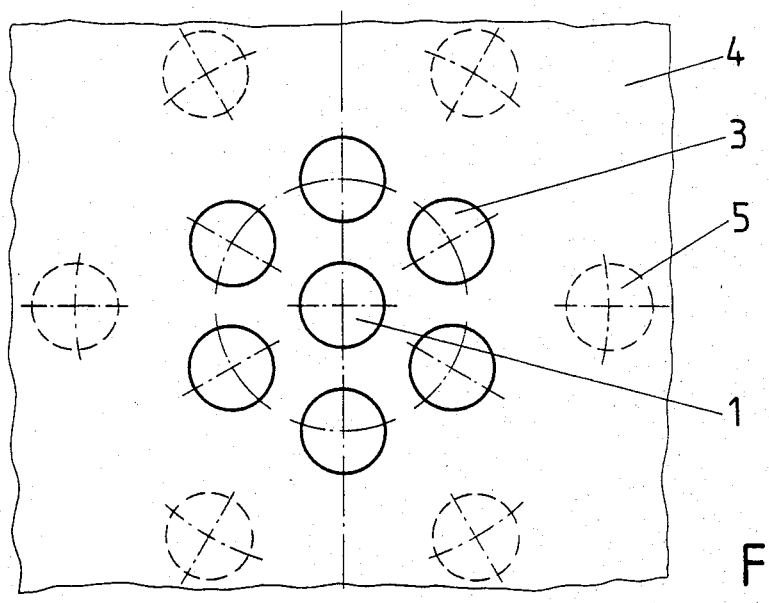
Figure 3:
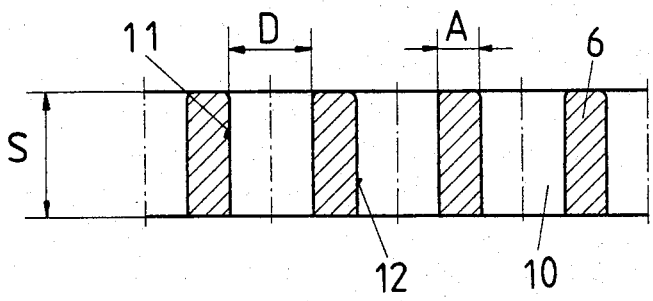
Figure 4:
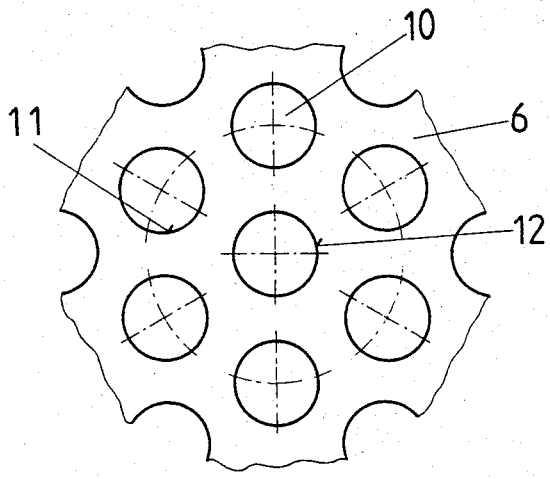
Figure 5:
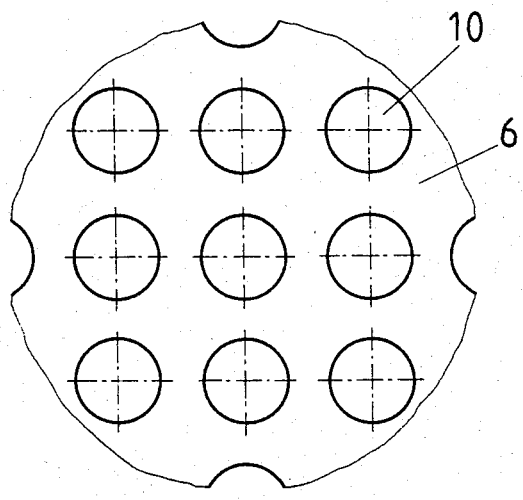
Figure 6:
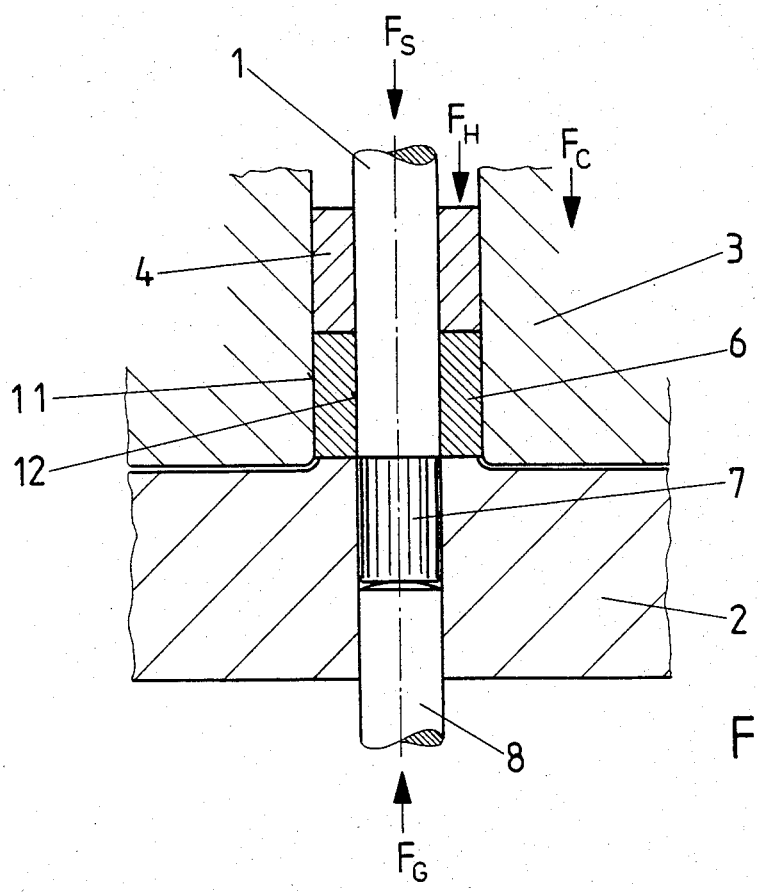
Figure 7:
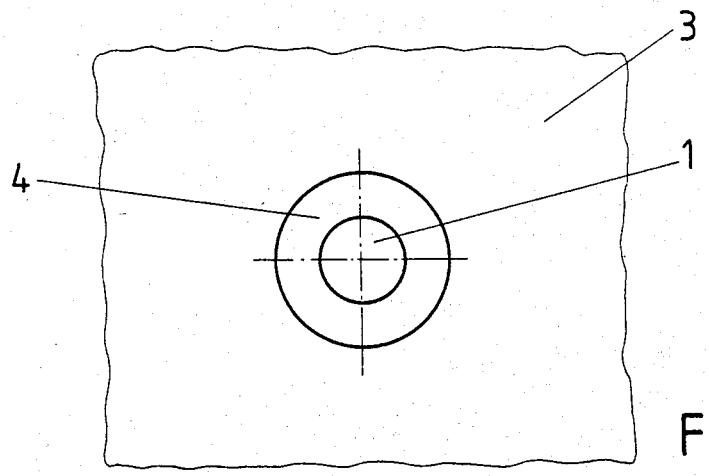
Figure 8:
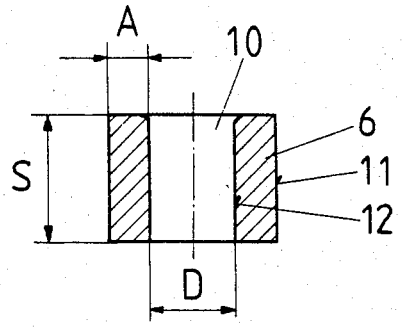
Figure 9:
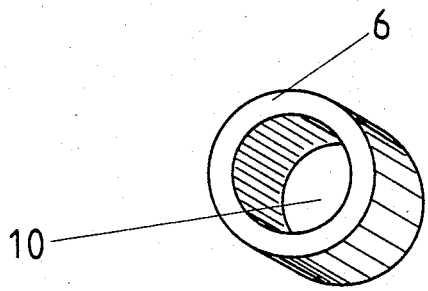
Figure 10:
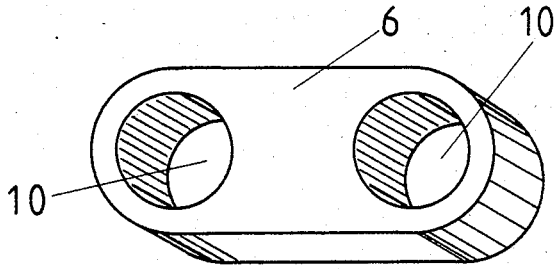
Figure 11:
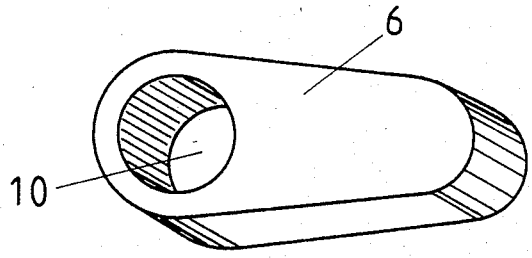
Figure 12:
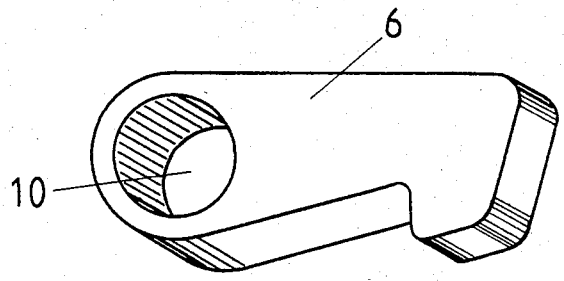
Figure 13:
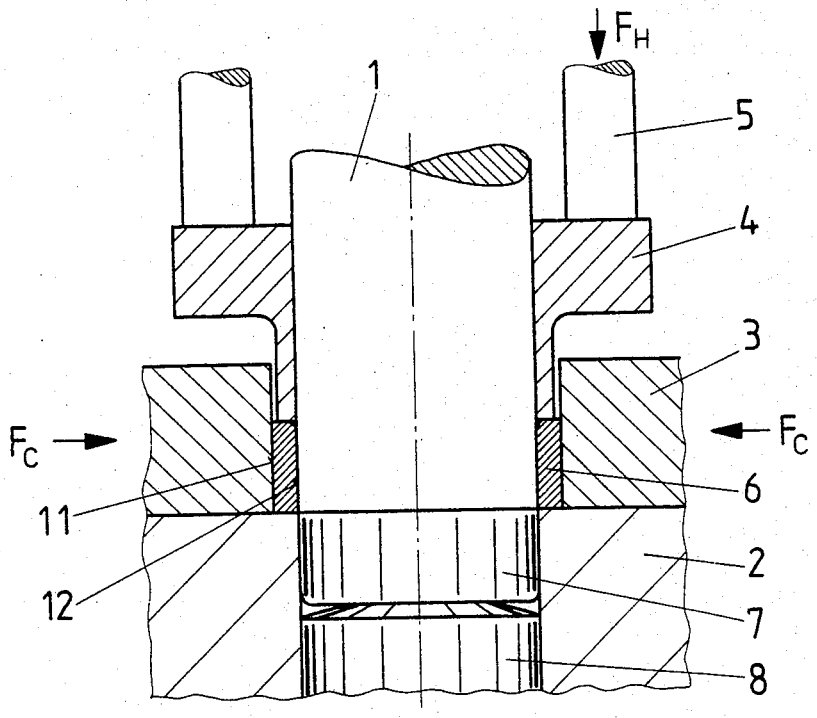
Figure 14:
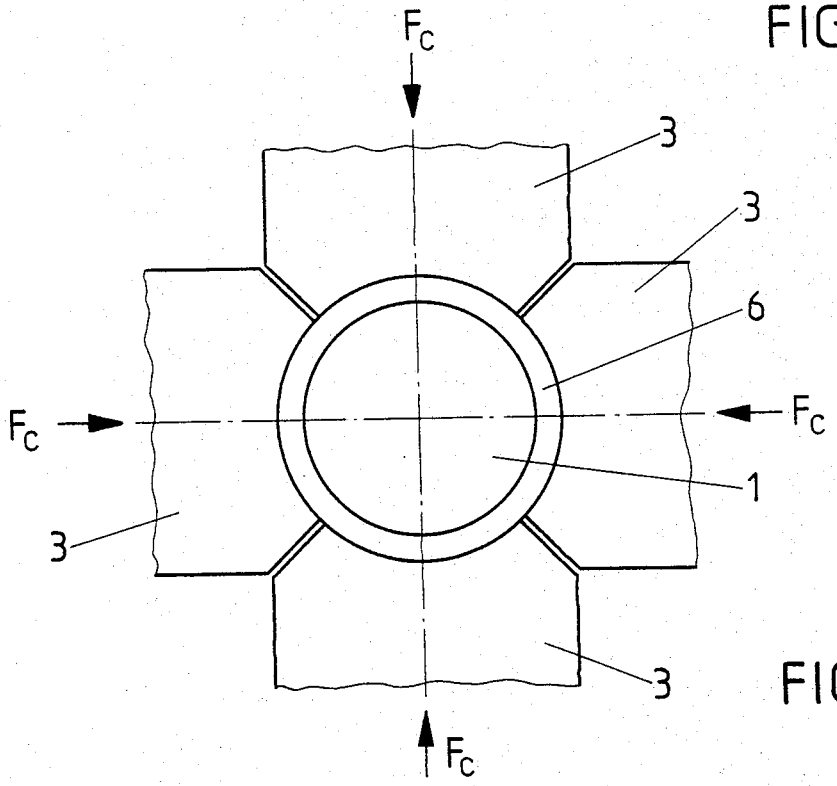
Figure 15:
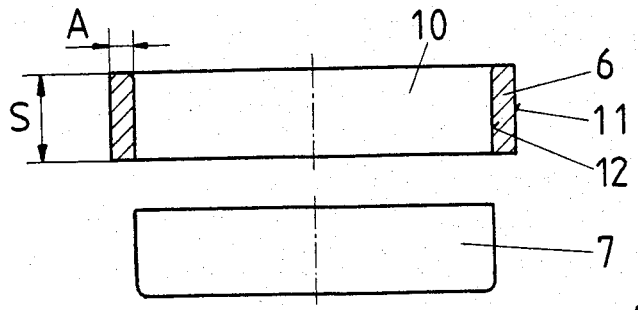
Figure 16:
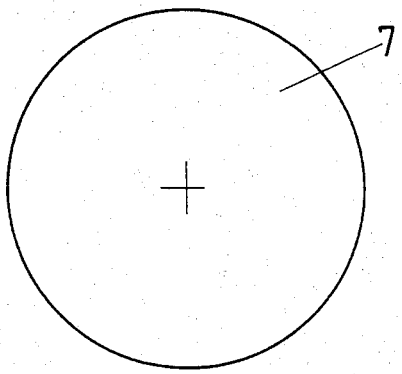
Figure 17:
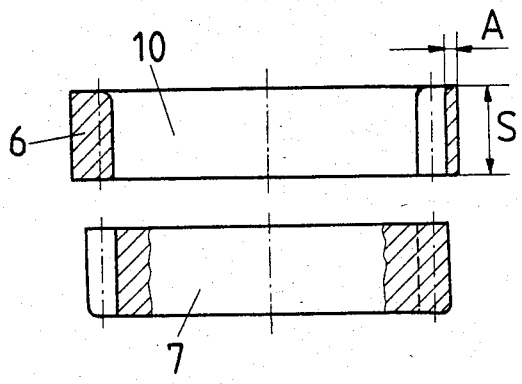
Figure 18:
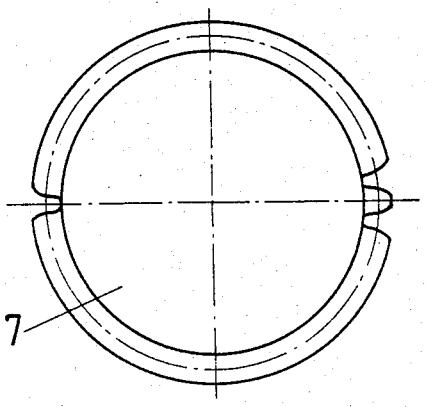

The invention is explained in more detail below with reference to exemplary embodiments illustrated in the drawings in which:

FIG. 1 shows, in a cross-section, a first embodiment of the invention for making perforated plates, FIG. 2 shows the embodiment according to FIG. 1 in a plan view, FIG. 3 shows the cross-section of a perforated plate made by means of an embodiment according to FIGS. 1 and 2, FIG. 4 shows a plan view of a perforated plate with a first pattern of holes, which has been made by means of an embodiment according to FIGS. 1 and 2, FIG. 5 shows a plan view, as in FIG. 4, with a second pattern of holes, FIG. 6 shows, in a cross-section, a second embodiment of the invention for making a hole in a prefabricated external shape, FIG. 7 shows the embodiment according to FIG. 6 in a plan view, FIG. 8 shows the cross-section of a part made by means of an embodiment according to FIGS. 6 and 7, FIG. 9 shows the part according to FIG. 8 in a perspective representation, FIGS. 10 to 12 show different types of parts made by means of an embodiment according to FIGS. 6 and 7, FIG. 13 shows, in a cross-section, a third embodiment of the invention for making external shapes from prefabricated blanks, FIG. 14 shows the embodiment according to FIG. 13 in a plan view, with the retaining member removed, FIG. 15 shows, in a cross-section, the stamping screen and, in a side view, the stamped part of a material machined by means of an embodiment such as that in FIGS. 13 and 14, FIG. 16 shows the plan view of the stamped part of FIG. 15, FIG. 17 shows, in a cross-section, the stamping screen and, in a partial cross-section, the stamped part, designed as a gearwheel, of a material machined by means of an embodiment such as that in FIGS. 13 and 14, and FIG. 18 shows the plan view of the gearwheel of FIG. 17.

FIGS. 1 and 2 illustrate a cutting punch 1, designed as a piercing punch, which passes through the the material to be pierced. The material to be pierced is clamped between the retaining member 4, designed as a retaining plate, and the cutting plate 2, as far as the cutting plate 2. The piercing punch 1 is moved forwards with the cutting force $F_S$. The pressure pad 8 counteracts this punch with the counterforce $F_G$. The stamped part 7 cut out of the stamping screen 6 is illustrated between the piercing punch 1 and pressure pad 8. Consequently, here, the stamping screen 6 is a perforated plate, and the stamped part 7 is a waste slug. The retaining force $F_H$ is transmitted to the retaining plate 4 by means of the thrust bolts 5.

However, in contrast to the state of the art, the material to be cut is not held firmly by means of a knife-edged ring provided on the retaining plate 4. Instead, the retaining plate 4 has special holes 9, through which pass longitudinally movable supporting punches 3. These support the material to be pierced against the shell surfaces 11 of the holes adjacent to the cutting line 12. The holes 9 have a diameter 1.02 to 1.06 times the diameter of the supporting punches 3, so that a play x is obtained, and any jamming is prevented. The piercing punch 1 is surrounded on all sides by supporting punches 3. The diameter of a supporting punch 3 is equal to the diameter D of the piercing punch 1 or of the hole to be cut, so that the holes in the material to be pierced, which are adjacent to the cutting line, are supported over their entire shell surface.

The shortest distance A (see FIG. 3) between the piercing punch 1 and an adjacent supporting punch 3 can be between $\frac{1}{3}$ and $\frac{2}{3}$ of the thickness S of the material to be cut, and the diameter D of the piercing punch 1 can be between $\frac{2}{3}$ and 1/1 of the thickness S, and yet high-quality cut faces are obtained without breaking-off. This is completely unattainable by means of known techniques, even by precision-cutting with a knife-edged ring.

The apparatus illustrated in FIGS. 1 and 2 is preferably suitable for making perforated plates such as those in FIGS. 4 and 5, for example sieves or supporting plates, and is operated as follows:

Firstly, the material to be pierced is clamped between the cutting plate 2 and the retaining plate 4 with a holding force $F_H$. The supporting punches 3 are drawn upwards with the control force $F_C$. The piercing punch 1 is then pushed through the material with the cutting force $F_S$. The pressure pad 8 counteracts this with the counterforce $F_G$. By means of this action, the waste slug 7 is cut out of the material, so that the desired hole is obtained and the stamping screen or perforated plate 6 remains behind.

This first piercing operation can be carried out without the cooperation of the supporting punches 3, since the piercing region has not yet been weakened by surrounding holes.

Clamping the material by means of the forces $F_H$ and $F_G$ prevents the material from bending, and, after the piercing operation has been carried out, the force $F_H$ ensures that the stamping screen 6 is stripped off from the piercing punch 1 when the latter is withdrawn.

After the first piercing operation has been completed, the retaining plate 4 then strips off from the piercing punch the stamping screen or perforated plate 6, which is then displaced until the first hole cut comes to rest under a supporting punch 3. The stamping screen 6 can be displaced into the new hole position by hand or via automatically operated coordination.

The supporting punch 3 is then introduced into the cut hole, the material is thereafter clamped by means of the retaining plate 4, and, finally, the next hole is cut by means of the piercing punch 1 acting against the pressure pad 8. In this piercing operation, the supporting punch 3 introduced into the first hole already has a laterally supporting effect.

These working cycles are repeated, and all the supporting punches 3 are introduced, as soon as the corresponding number of holes have been cut.

The retaining plate 4 carries the shape and mutual spacing of the pattern of holes to be cut into the material.

As is evident, the process consists of four cycles, that is to say, the apparatus according to the invention has a four-fold action.

Basically, the individual elements of the apparatus can be driven mechanically or hydraulically. However, a hydraulic drive is advantageous, because the individual forces, speeds of the elements, and cutting distance can be controlled better thereby.

FIG. 3 shows a cross-section of a perforated plate of a type which can be made in the way described above. The cut faces of the holes are smooth and free of break-offs. The limiting values obtainable are $D/S \geqq \frac{2}{3}$; $A/S \geqq \frac{1}{3}$.

The invention can be used, in the embodiment described, for example in the manufacture of sorting sieve plates for seed, sorting sieve plates for food processing, cutting plates for a meat-mincer, cooling-pipe support plates for reactors, etc.

FIGS. 6 and 7 illustrate an embodiment of the invention which corresponds to that shown in FIGS. 1 and 2, with the exception of the following particular features:

A perforated plate in the manner of a sieve or the like is not to be made here, but one or more holes are to be cut into an already finished external shape, and the distance of the edge of the hole to be cut from the outer edge of the material can be, if appropriate, only $\frac{1}{3}$ of the material thickness.

In this embodiment of the invention, the lateral support is provided by a supporting member 3 designed as a supporting plate which surrounds the cutting punch 1 concentrically and which can move in its direction. By means of its inner clearance, the supporting plate is locked positively with the external shape to be pierced. Consequently, the supporting plate 3 supports the external shape on its shell surface 11 by means of positive locking. The positive lock is obtained because the supporting plate 3 is designed to match the external shape. The supporting plate 3 is moved vertically with the control force $F_C$. It must be sufficiently stable to ensure that it can absorb the horizontal forces issuing from the stamping screen 6 during cutting.

The apparatus is operated, in principle, as described with regard to FIGS. 1 and 2. That is to say, the external shape is first clamped by means of the annular retaining member 4 and supported laterally by means of the supporting plate 3, and is then pierced by means of the cutting punch 1 and pressure pad 8.

Because the shapes to be pierced are supported laterally by positive locking, it is possible to make round or shaped holes with very small diameters and/or web and edge widths in relation to the material thickness. Extremely smooth hole walls with maximum dimensional accuracy, such as are not attainable by means of a conventional drilling, milling or stamping operation, are obtained, with, at the same time, a long life of the tool. Examples are illustrated in FIGS. 8 to 12.

FIGS. 13 and 14 illustrate a further embodiment of the invention which corresponds to those shown in FIGS. 1, 2 and 6, 7, with the exception of the following particular features:

The tool illustrated serves for producing external shapes with high-quality cut faces from prefabricated blanks.

Here, the supporting member 3 consists of four clamping parts which can be applied to the shell surface 11 of the blank with frictional and positive locking and which are moved with the control force $F_C$. The retaining member 4 is designed as an annular attachment of a pressure part connected with the thrust bolts 5.

The clamping parts or the control force $F_C$ provide support for the blank during cutting.

Parts such as those in FIGS. 15 to 18 can be made by means of this tool.

According to FIGS. 15 and 16, circular blanks 7, which can be reshaped into sleeves, for example, in a subsequent extrusion operation, are cut out. The stamping screen 6, here in the form of a waste ring, has an extremely small edge width A in relation to the material thickness S, for example 30% of S. In this way, a substantial saving of material is achieved, despite a high-quality cut face.

In FIGS. 17 and 18, the stamped part 7 is a gearwheel. The stamping screen 6 illustrated at the top in FIG. 17 is a waste ring having the edge width A with internal toothing. Here, too, the edge width A can be made extremely small, so that, even here, a noticeable saving of material is achieved, despite an outstanding quality of the tooth faces cut.

By means of the invention, not only improvements in quality and an increase in the tool life are achieved, but also considerable savings of costs in production:

Thus, for example, a length to be drilled of 120 m results in the case of a cooling-coil support plate consisting of St3 sheet steel 20 mm thick, with the external dimensions 2,000 mm×4,000 mm and with 6,000 holes 18 mm in diameter. 200 working hours would be required for the drilling. However, only 25 hours are needed as a result of the application of the invention.

For the machining of parts in which the web and edge width A is to be especially small, it is important that the supporting members 3 are brought into supporting contact with all those portions of the shell surface 11 of the part, of which the distance from the cutting line 12 is less than the material thickness S.

When especially small holes are made, the part must be supported, if possible, on its entire periphery. Cutting is thereby made easier, and the service life of the tool is lengthened considerably.

I claim:

1. A process for precision cutting a hole in a workpiece which is less than 30 mm thick in the direction of the cut where the hole comes within 30 mm of an edge of the workpiece, said process comprising the steps of:

(a) clamping a workpiece (6) the thickness S of which is less than 30 mm and which is unheated between a smooth surfaced cutting plate (2) having a bore therein for the receipt of a waste slug (7) located underneath the hole to be cut and a smooth surfaced retaining member (4), both said cutting plate (2) and said retaining member (4) lacking a knife edge ring surrounding the hole to be cut;

(b) prior to undertaking a cutting operation, supporting the workpiece (6) laterally adjacent the hole to be cut therein at a point where the distance A between the nearest edge of the hole to be cut and an edge of the workpiece is both less than 30 mm and less than the thickness S of the workpiece (6) with at least one supporting member (3);

(c) prior to undertaking a cutting operation, supporting the workpiece (6) beneath the hole to be cut with pressure pad (8) movably mounted in said bore; and (d) cutting a hole in the workpiece (6) with a cutting punch (1) which is movable independently of said at least one supporting member (3), said cutting punch (1) cutting out a waste slug (7) which it ejects into said bore against a counterforce supplied by said pressure pad (8), said pressure pad (8) yielding before forward movement of said cutting punch (1), thereby leaving a precision-cut hole in the workpiece (6) which is spaced laterally from said at least one supporting member (3) by a distance A which is both less than 30 mm and less than the thickness S of the workpiece (6).

2. A process as recited in claim 1 wherein:

(a) the workpiece (6) is planar and (b) the planar surfaces of the workpiece (6) are perpendicular to the hole cut by said cutting punch (1).

3. A process as recited in claim 2 wherein the workpiece (6) is between 0.3 mm and 15 mm thick.

4. A process as recited in claim 2 wherein the workpiece (6) is between 1 mm and 20 mm thick.

5. A process as recited in claim 1 wherein said at least one supporting member (3) is brought into supporting contact with the entire lateral periphery of the workpiece (6) perpendicular to the axis of said cutting punch (1).

6. A process as recited in claim 1 wherein the radially outer surface of said cutting punch (1) and the nearest point on said at least one supporting member (3) is between $\frac{1}{3}$ and $\frac{2}{3}$ of the thickness of the workpiece (6).

7. A process as recited in claim 1 wherein:

(a) said cutting punch (1) is circular in cross section and (b) the diameter of said cutting punch (1) is between $\frac{2}{3}$ and 1/1 of the thickness of the workpiece (6).

8. A process as recited in claim 1 wherein said at least one supporting member (3) is a supporting punch which has the same cross sectional contour as said cutting punch (1).

9. A process as recited in claim 8:

(a) wherein said retaining member (4) has at least one hole (9) sized and positioned to slidably receive said at least one supporting punch and (b) comprising the further steps of:

(i) after said cutting punch (1) has cut a first hole in the workpiece (6), moving the workpiece (6) so that said first hole is coincident with said at least one hole (9) in said retaining member (4) and then (ii) positioning said supporting punch in said at least one hole (9) and said first hole before performing another cutting step.

10. A process as recited in claim 9:

(a) wherein said retaining member (4) has a plurality of holes (9) sized and positioned to slidably receive a plurality of supporting punches and (b) comprising the further steps of:

(i) after said cutting punch (1) has cut a first hole in the workpiece (6), moving the workpiece (6) so that said first hole is coincident with one of said plurality of holes (9) in said retaining member (4); then (ii) positioning one of said supporting punches in said one of said plurality of holes (9) and said first hole before performing another cutting step; and then (iii) iterating steps (b)(i) and (b)(ii).

11. A process as recited in claim 10 wherein said plurality of supporting punches are uniformly distributed around said cutting punch (1).

12. A process as recited in claim 9 wherein:

(a) said at least one supporting punch is circular in cross section and (b) said at least one hole (9) has a diameter of between 1.02 and 1.06 times the diameter of said at least one supporting punch.

13. A process as recited in claim 8 wherein the shortest distance between the radially outer surface of said cutting punch (1) and the nearest point on said at least one supporting punch is between $\frac{1}{3}$ and $\frac{2}{3}$ of the thickness of the workpiece (6).

14. A process as recited in claim 8 wherein:

(a) said cutting punch (1) is circular in cross section and (b) the diameter of said cutting punch (1) is between $\frac{2}{3}$ and 1/1 of the thickness of the workpiece (6).

15. A process as recited in claim 1 wherein:

(a) said at least one supporting member (3) is a supporting plate which surrounds the workpiece (6) and which is concentrically movable perpendicularly to the direction of motion of said cutting punch (1) so that it can be brought into positive contact with the entire periphery of the workpiece (6) and (b) step (b) of claim 1 is accomplished by moving said supporting plate concentrically until it is in positive contact with the entire periphery of the workpiece (6).

16. A process as recited in claim 15 wherein:

(a) said retaining member (4) is a ring which surrounds said cutting punch (1) and (b) said supporting plate also surrounds said ring and is also concentrically movable perpendicularly to the direction of motion of said cutting punch (1) so that it can be brought into positive contact with the entire periphery of said ring.

17. A process as recited in claim 16 wherein said ring and the workpiece (6) have the same peripheral configuration.

18. A process as recited in claim 15 wherein the shortest distance between the radially outer surface of said cutting punch (1) and the radially inner surface of said supporting plate is between $\frac{1}{3}$ and $\frac{2}{3}$ of the thickness of the workpiece (6).

19. A process as recited in claim 15 wherein:

(a) said cutting punch (1) is circular in cross section and (b) the diameter of said cutting punch (1) is between $\frac{2}{3}$ and 1/1 of the thickness of the workpiece (6).

20. A process as recited in claim 1 wherein a plurality of supporting members (3) in the form of clamping parts movable perpendicularly to said cutting punch (1) to grip the workpiece (6) on opposing peripheral sides thereof.

21. A process as recited in claim 20 wherein said retaining member (4) is a ring which surrounds said cutting punch.

22. A process as recited in claim 20 wherein the shortest distance between the radially outer surface of said cutting punch (1) and the nearest point on said clamping part is between $\frac{1}{3}$ and $\frac{2}{3}$ of the thickness of the workpiece (6).

23. A process as recited in claim 20 wherein:

(a) said cutting punch (1) is circular in cross section and (b) the diameter of said cutting punch (1) is between $\frac{2}{3}$ and 1/1 of the thickness of the workpiece (6).

* * * * *